United States Patent [19]

Kramer

[11] Patent Number: 4,555,174

[45] Date of Patent: Nov. 26, 1985

[54] MAGNETICALLY ATTRACTABLE DEVELOPER MATERIAL TRANSPORT APPARATUS

[75] Inventor: George J. Kramer, Troy Township, St. Croix County, Wis.

[73] Assignee: Minnesota Mining and Manufacturing Company, St. Paul, Minn.

[21] Appl. No.: 563,123

[22] Filed: Dec. 19, 1983

[51] Int. Cl.[4] ..... G03G 15/00

[52] U.S. Cl. ..... 355/3 DD; 141/DIG. 1; 118/658; 222/DIG. 1

[58] Field of Search ..... 118/656, 657, 658, 262; 355/3 DD, 3 R; 222/DIG. 1, 365; 141/DIG. 1; 198/679, 690

[56] References Cited

U.S. PATENT DOCUMENTS 2,846,333 8/1958 Wilson ..... 117/17.5

3,113,042 12/1963 Hall ..... 118/637

3,635,553 1/1972 Adamek et al. ..... 355/3

*Primary Examiner*—A. T. Grimley

*Assistant Examiner*—David Warren

*Attorney, Agent, or Firm*—Donald M. Sell; James A. Smith; Robert L. Marben

[57] ABSTRACT

Apparatus for conveying magnetically attractable particles from a first position to a second position including a support member, such as a disc, adapted for rotation and having at least one surface area at which a magnetic field is presented that passes between the first and second positions. More than one support member, each having at least one surface area at which a magnetic field is presented provides another arrangement wherein the support members are serially arranged to extend between the first and second positions so the magnetically attractable particles are carried from one support member to the next.

15 Claims, 4 Drawing Figures

MAGNETICALLY ATTRACTABLE DEVELOPER MATERIAL TRANSPORT APPARATUS

BACKGROUND OF THE INVENTION

1. Field of the Invention

This invention relates to electrographic systems and, in particular, it relates to apparatus for the transport of developer material containing magnetically attractable particles for the development of latent electrographic images. More particularly, this invention relates to an apparatus having a single transport member for conveying such magnetically attractable particles from a first position to a second position where the developer material can be transported further and utilized to develop the latent image.

2. Description of the Prior Art

Various devices are known for transporting developer material containing magnetically attractable particles from a supply of the developer material to a latent image bearing surface or to some form of applicator for subsequent presentation to a latent image bearing surface. Such devices include the employment of an endless conveyer belt/elevator configuration with buckets for transporting developer material for delivery to an elevated position and subsequent delivery to a latent image bearing surface, e.g., a photosensitive drum. Such configurations are relatively costly and complex and do not lend themselves to compact installations.

U.S. Pat. No. 3,635,553 discloses an improved means for transporting developer material to a remote location. A rotatable frame, having a plurality of scoops mounted thereon, which rotates through a sump of developer material and then to an elevated position is described. Each scoop contains an orifice through which developer can enter from the sump and be discharged at the elevated position to cascade over a photosensitive plate. Such a device has the disadvantages of being relatively complex and of creating an undesirable degree of agitation and subsequent uncontrolled distribution of some of the developer material in unwanted areas of the device especially when operated at high speeds.

U.S. Pat. No. 3,113,042 discloses a means whereby a magnetically attractable developer material is conveyed from a reservoir to a remote location by a stationary conveyor mechanism. A series of sequentially energized electromagnets, extending in a linear array behind a smooth surfaced nonmagnetic member and extending from a remote reservoir to a photoconducive surface, are utilized to transport developer material from the reservoir. While this means does provide for better control of the developer material, it again is relatively costly to produce and does not lend itself to a small and compact design.

U.S. Pat. No. 2,846,333 discloses the use of a plurality of like discs which are spaced apart along a rotatable shaft and are fastened to the shaft at an angle of less than 90 degrees. A magnetic field is presented at the edge of the discs. The shaft and a moving photoconductor are positioned so that photoconductor passes close to the edge of each disc with the discs extending into a hopper containing magnetically attractable developer particles. As the discs are rotated, developer particles are carried at the edge of each disc to the space between the photoconductor and the discs where some of the particles are deposited on the photoconductor. Such apparatus requires a multiplicity of discs with the discs oriented so the edges of the discs are parallel to the surface of the photoconductor. With this arrangement, a substantial amount of space, as well as a large number of discs, is required for the apparatus for movement of the developer material from the hopper to the photoconductor.

SUMMARY OF THE INVENTION

Apparatus embodying the present invention avoids the complexity and bulkiness associated with the prior known developer material transport apparatus. Such apparatus provides for the transport of magnetically attractable developer material presented at a first position to a second position where a surface area is present at which a magnetic field is provided to attract the magnetically attractable material from the apparatus wherein the apparatus includes a single disc member adapted for rotation about an axis that is perpendicular to the disc member with a planar surface area provided at the disc member at which a magnetic field is presented.. Rotation of the disc member causes the planar surface area to move between the first position and second position. The disc member is oriented so the planar surface area moves parallel to and in close proximity to the surface area present at the second position. Since the disc member of the apparatus provides a planar surface area at which a magnetic field is present and is operative to move it between two positions, the apparatus can be very compact, reliable in operation and low in manufacturing cost. The developer material transport apparatus of the present invention provides for conveyance of the developer material which is always under the influence of a magnetic field, so in cases where the developer is only magnetically attractable toner particles, there is no need for additional structure to prevent the toner from being deposited on other portions of the device of which the transport apparatus is a part. In addition, an elongate member, such as a piece of wire, can be secured to the support means so as pass through the developer particles that will be supplied at the first position serving to agitate the developer particles and thus ensure presentment of developer material to the surface area at which a magnetic field is presented. The disc member can be formed from a material that provides the magnetic field for the planar surface area or a separate field producing means that is a part of the disc member can provide the magnetic field for the planar surface area. While not required, the planar surface area having the magnetic field can encircle the axis of rotation for the disc member.

Considering the apparatus further, one embodiment includes a hopper or developer material reservoir for receiving magnetically attractable developer material for providing the first position and a cylindrical developer shell that provides the second position. The developer shell has a magnetic field producing means positioned within the shell that is effective to move developer material from the disc member at the point where it passes parallel to and near the shell. The shell and/or the magnetic field producing means within the shell are adapted for rotation to effect movement of the toner particles about and along the outer surface of the shell.

Another embodiment illustrates how more than one disc member is used to transport magnetically attractable developer material from a hopper or developer material reservoir to a cylindrical developer shell by arranging the discs in series so the developer material is moved from one disc to the next. A first disc member is positioned to receive magnetically attractable developer material from a hopper or developer reservoir and a second disc member is positioned parallel to and near the developer shell with the first disc member positioned to transport developer material to the second disc member or, if necessary, to a third disc member positioned to receive developer material from the first disc member and present it to the second disc member or, if necessary, to a fourth disc member positioned for transporting the developer material to the second disc member.

BRIEF DESCRIPTION OF THE DRAWINGS

The novel features and advantages of the invention presented herein will become more apparent to those skilled in the art upon consideration of the following detailed description and referenced drawing wherein.

DETAILED DESCRIPTION

Figure 1:
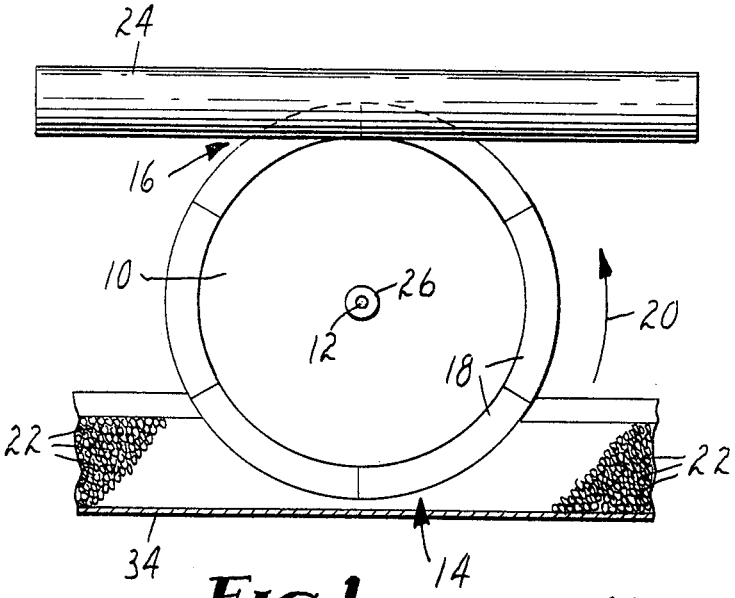
FIG. 1 is a schematic showing of the basic portions of an apparatus embodying the invention.

Referring to FIG. 1 of the drawing, a schematic showing is presented depicting the basic parts of an apparatus embodying the invention. The apparatus includes a support member 10, shown as a disc, that is adapted for rotation about an axis such as that provided by a rotatable shaft 12 to which the support member is fastened. The shaft 12 is positioned so that at least one planar surface area 18 of the support member 10 will move between a first position indicated generally at 14 and a second position indicated generally at 16 when the support member 10 is rotated.

The apparatus described in connection with FIG. 1 is usable for transporting magnetically attractable developer particles 22 present at the first position 14, such as a developer sump or reservoir 34, to a developer roll assembly at position 16. The developer roll assembly is depicted by the cylindrical sleeve 24. The developer roll assembly 24 can be of a type that is well known and used extensively in office copiers wherein a plurality of elongate magnets 36 (FIG. 2) are positioned to extend axially within the cylindrical sleeve of the assembly with either the sleeve and/or the magnets adapted for rotation. The surface area 18 of the support member 10 passes close and parallel to the developer roll assembly 24 to carry developer particles 22 from position 14 to the developer roll assembly 24. The magnetic force provided at the developer roll assembly 24 is strong enough to attract the developer particles from the surface area 18 at the support member 10 as it moves adjacent the developer roll assembly.

While a single surface area 18 at support member 10 is sufficient to transport the developer particles 22, the speed of rotation of the support member 18 for a given application can be reduced if a number of surface areas 18 are used such as shown in FIG. 1 wherein five surface areas 18 are shown which extend around the entire periphery of the support member 10. If a single surface area 18 is used, the support member 10 need only be a portion of the disc shown in FIG. 1 or a simple rod or arm-like member fastened to the shaft 12 with a separate flat member secured to the other end of the rod which provides the surface area 18 at which a magnetic field is present.

A preferred embodiment for the support member 10 is a disc of nonmagnetic material, such as aluminum, wherein the surface areas 18 are provided by separate flat, magnetic segments that are attached to the outer peripheral portion of the disc. The magnetic segments providing the surface areas 18 can be formed from polymer based flexible permanent magnets which are available from Minnesota Mining and Manufacturing Company, 3M Center, St. Paul, Minn., U.S.A. and sold under its trademark "Plastiform". Such magnets are available in sheet form and can be die-cut, stamped or otherwise formed as required to provide the surface areas 18. Such magnets are made to provide spaced apart magnetic poles. The "Plastiform" magnetic material is available with various numbers of poles per length. A thickness as small as about 0.1 cm. for the segments providing surface areas 18 can be used.

Figure 2:
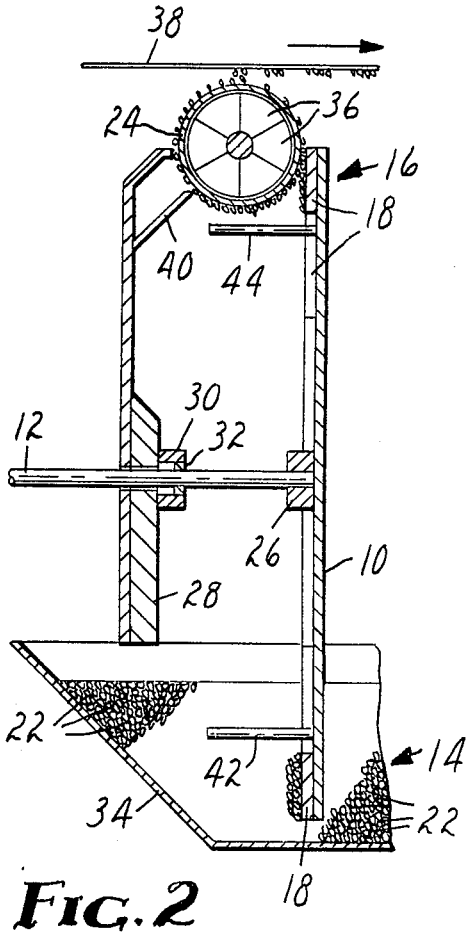
FIG. 2 is a cross-sectional end view of an apparatus embodying the invention.

Referring to FIG. 2, a more detailed showing is presented of apparatus embodying the invention for transporting magnetically attractable developer particles presented at a first position to a second position at which a magnetic field is present to attract the particles from the apparatus. Element shown in FIG. 2 that are like or similar to those described in connection with FIG. 1 are identified by the same reference numerals used for such elements in FIG. 1.

As in FIG. 1, apparatus of the invention shown in FIG. 2 includes a support member 10, shown as a disc, adapted for rotation about an axis such as that provided by a rotatable shaft 12 to which the support member is fastened such as by a set screw (not shown) carried by a shaft support member 26 that is secured to the support member 10. A bearing wall 28, which may be provided by equipment in which the apparatus is used, provides an opening and a journal element 30 in which a bearing 32 is positioned. The shaft 12 is positioned to pass through the bearing 32 and the opening provided in the wall 28 for coupling to a drive mechanism (not shown) for rotation of the shaft 12 at a desired time and speed. The shaft 12 is positioned midway between a first position 14 at which magnetically attractable developer particles 22 are present and a second position 16 to which the particles are carried by at least one surface area 18 located at a peripheral portion of support member 10 and at which a magnetic field is present. As in the case of FIG. 1, several surface areas 18 are provided and are supplied in the manner described in connection with FIG. 1.

The magnetically attractable developer particles 22 are disposed in a developer sump or reservoir 34 located at the one position 14. As in FIG. 1, a developer transport roll assembly is positioned at the second position 16. The developer transport roll assembly includes a cylindrical sleeve 24 in which a plurality of elongate magnets 36 are disposed that extend axially of the sleeve. The magnets 36 are spaced from the sleeve 24 and present alternate magnetic poles about the circumference. The sleeve 24 is formed from nonmagnetic material such as aluminum. The sleeve 24 and/or the magnets 36 are adapted for rotation. The developer transport roll assembly is disposed so the sleeve 24 is parallel to the support member 10 and spaced close enough to the support member 10 so the magnetically attractable developer particles carried at the surface areas 18 can be attracted to the sleeve 24 by the magnets 36.

The magnetically attractable developer particles attracted to the sleeve 24 are moved clockwise and also lengthwise of the sleeve 24 by clockwise rotation of the sleeve 24 or by counterclockwise rotation of the magnets 36 with the sleeve 24 stationary.

The apparatus is usable for bringing the developer particles to the developer roll assembly 36 which can then transport the particles for presentation to an element 38, such as photoconductive drum or belt, at which an electrical potential pattern is present for development of the pattern. This use is illustrated in FIG. 2 wherein the element 38 is moved from left to right and is positioned a short distance from the sleeve 24 so that the developer particles can be influenced by the electrical potential pattern to develop the pattern. A doctor blade 40 is positioned adjacent the sleeve 24 in the path of movement of the developer particles to the element 38 to control the level of the developer particles presented to the element 38. Excess developer particles are removed from the sleeve 24 by the blade 40 and are returned by gravity to the developer reservoir 34.

A further aspect of the apparatus of FIG. 2 is the provision of at least one elongate member 42 that is attached at one end to the support member 10 and extends outwardly from the support member 10 so that it passes through the developer particles when present in the developer reservoir 34. The apparatus of FIG. 2 is shown with a second elongate member 44 positioned diametrically opposite the member 42. The members 42 and 44 can be made from a rigid or flexible material. The elongate members 42 and 44 serve to aid the flow of the developer particles to the lower portion of the reservoir 34 for attraction to the surface areas 18 of the support member 10.

While the apparatus of FIG. 1 is illustrated using only one support member 10, more than one support member 10 can be used for moving developer particles from the reservoir 34. One or more support members 10 can be spaced from the support member 10 shown and positioned between the reservoir 34 and the developer roll assembly. They require separate drive shafts 12 that can be arranged for rotation by the same or a separate drive mechanism (not shown) from that used for the member 10 of FIGS. 1 and 2.

Figure 4:
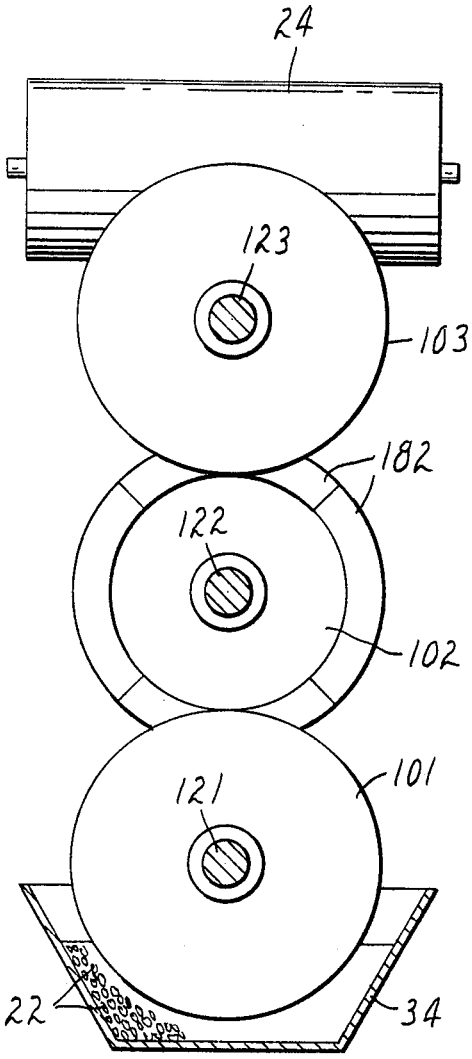
FIG. 4 is a view of the apparatus of FIG. 3 taken on the line 4—4 of FIG. 3.
Figure 3:
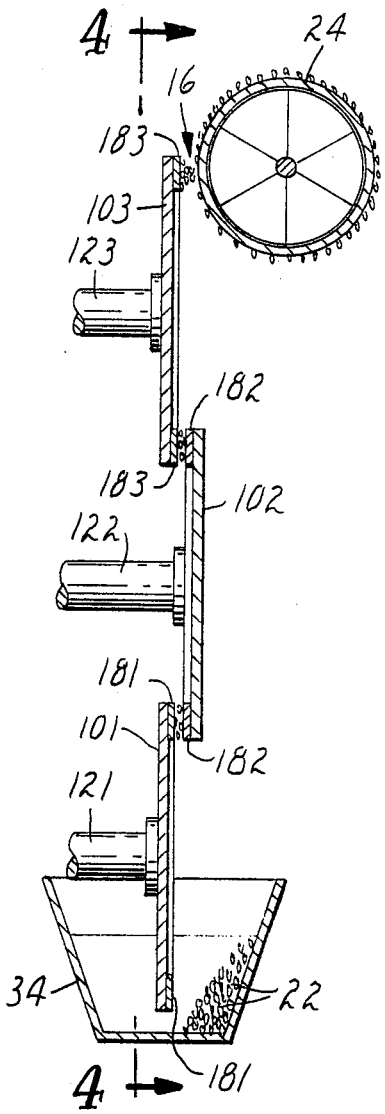
FIG. 3 is a cross-sectional end view of another apparatus embodying the invention.

There are situations where magnetically attractable particles must be moved for a distance that is too great for such movement to be accomplished by the use of apparatus using a single support member 10 and associated surface areas 18 as illustrated in FIGS. 1 and 2. In such cases, the distance can be spanned by the use of more than one support member 10 as shown in FIGS. 3 and 4 wherein three support members 101, 102 and 103 are used which are constructed in the same manner as support member 10 as described for FIGS. 1 and 2. Surface areas, at which a magnetic force is provided, are provided for support members 101, 102 and 103 by surface areas 181, 182 and 183, respectively. The support members 101, 102 and 103 are mounted for rotation via separate drive shafts 121, 122 and 123, respectively. The support members 101, 102 and 103 are serially spaced and arranged so the surface areas 181 of member 101 pass close to the surface areas 182 of member 102 which in turn pass close to the surface areas 183 of member 103. As in the case of the arrangement shown in FIGS. 1 and 2, the support members 101, 102 and 103 can be used to transport magnetically attractable developer particles 22 from a first position 14, such as a developer sump or reservoir 34, to a second position 16 at which a developer roll assembly, for example, as shown by the cylindrical sleeve 24, may be located. The developer roll assembly may take the form of the roll assembly described in connection with FIGS. 1 and 2 and can be used to present the developer particles to an electrical potential pattern presented at a photoconductor (not shown) as described in connection with FIG. 2.

Operation of the apparatus of FIG. 4 requires a supply of magnetically attractable developer particles 22 to be placed in the reservoir 34. Upon rotation of the support members 101, 102 and 103 via their drive shafts 121, 122 and 123, respectively, by a drive mechanism(s) (not shown), developer particles are attracted to the area 181 of support member 101 from the reservoir 34 and are carried to a position opposite the area 182 provided at support member 102 where they are attracted to the area 182. Rotation of support member 102 causes the developer particles attracted to area 182 to be carried to a position opposite an area 183 of support member 103 where they are attracted to an area 183 of support member 103 and are then carried to the position 16 opposite the sleeve 24 of the developer roll assembly. The developer particles are attracted to the sleeve 24 due to the magnets positioned within the developer roll assembly. The developer particles then move along and about the sleeve 24 as in the case of the apparatus of FIG. 2.

Rotation of the support members 101, 102 and 103 can be either clockwise or counterclockwise. While the members 101, 102 and 103 are shown to be of the same diameter, this is not required and, in addition, a particular situation may only require two of the support members or more than two support members serially positioned between support members 101 and 103. While FIG. 4 shows the support members 101, 102 and 103 to be aligned vertically, this is not a requirement. In some situations, it may be necessary to move the developer particles to a position that is not directly above the supply of developer particles or it may be necessary to move the particles around an object in the apparatus which can be easily done by proper placement of the support members.

It will be appreciated that variations and modifications of the above-described embodiments may be made without departing from the spirit and scope of the invention.

I claim:

1. Apparatus for transporting magnetically attractable particles presented at a first position to a second position at which a magnetic field is present to attract magnetically attractable particles from the apparatus including:

a support member adapted for rotation about an axis that is located between the first and second positions, said support member having a planar surface area at which a magnetic field is presented, said planar surface area located at a distance from said axis that is greater than the dimension of said support member at said planar surface measured in the direction defined by said axis, said distance from said axis causing said planar surface area to move between the first and second positions upon rotation of said support member.

2. Apparatus according to claim 1 wherein the apparatus further includes an elongate member attached to and extending from said support member.

3. Apparatus according to claim 1 wherein said apparatus further includes a magnetic field producing means secured to said support member for providing the magnetic field at said planar surface area.

4. Apparatus according to claim 1 wherein the apparatus further includes:

a reservoir for receiving magnetically attractable developer material for providing the first position, and a cylindrical developer sleeve for providing the second position, said sleeve positioned above said reservoir and having a magnetic field producing means positioned within said shell.

5. Apparatus according to claim 4 wherein said sleeve is adapted for rotation.

6. Apparatus according to claim 4 wherein said magnetic field producing means positioned within said sleeve is adapted for rotation.

7. Apparatus according to claim 4 wherein said sleeve and said magnetic field producing means positioned within said sleeve are each adapted for rotation.

8. Apparatus according to claim 1 wherein said support member is a disc and said planar surface area is a portion of said disc adjacent the outer edge of said disc.

9. Apparatus according to claim 8 wherein said portion extends along the entire outer edge of said disc.

10. Apparatus according to claim 8 wherein said apparatus further includes an elongate member extending from said disc.

11. Apparatus according to claim 8 wherein said disc includes a magnetic field producing means at said portion.

12. Apparatus according to claim 11 wherein said magnetic field producing means includes a plurality of magnets secured to said portion.

13. Apparatus for transporting magnetically attractable particles presented at a first position to a second position at which a magnetic field is present to attract magnetically attractable particles from the apparatus including:

a plurality of support members, each having a different axis of rotation with each of said support members adapted for rotation about its axis, each of said support members having a planar surface area at which a magnetic field is presented, said support members serially positioned for bridging the space between the first and second positions with said planar surface area of any selected one of said support members facing at least a portion of said planar surface area of any of said support members adjacent to such selected one of said support members during a portion of a revolution about its axis of such selected one of said support members.

14. Apparatus according to claim 13 wherein each of said support members is a disc and said planar surface area thereof is a portion of said disc adjacent the outer edge of said disc.

15. Apparatus according to claim 13 wherein the apparatus further includes:

a reservoir for receiving magnetically attractable developer material for providing the first position, and a cylindrical developer sleeve for providing the second position, said sleeve positioned above said reservoir and having a magnetic field producing means positioned within said sleeve.

* * * * *